US009677565B1

(12) United States Patent
Rodriguez

(10) Patent No.: US 9,677,565 B1
(45) Date of Patent: Jun. 13, 2017

(54) HAND CRANK-POWERED FAN

(71) Applicant: Michael W. Rodriguez, Victoria, TX (US)

(72) Inventor: Michael W. Rodriguez, Victoria, TX (US)

( * ) Notice: Subject to any disclaimer, the term of this patent is extended or adjusted under 35 U.S.C. 154(b) by 357 days.

(21) Appl. No.: 14/445,618

(22) Filed: Jul. 29, 2014

Related U.S. Application Data

(60) Provisional application No. 61/905,532, filed on Nov. 18, 2013.

(51) Int. Cl.
*F04D 25/08* (2006.01)
*F04D 25/06* (2006.01)
*F04D 19/00* (2006.01)

(52) U.S. Cl.
CPC ..... *F04D 25/086* (2013.01); *F04D 19/002* (2013.01); *F04D 25/0673* (2013.01)

(58) Field of Classification Search
CPC ..... F04D 19/002; F04D 25/08; F04D 25/084; F04D 25/086; F04D 25/10; F04D 25/105; F04D 25/16; F04D 25/0673; F04D 29/403; F04D 29/52; F04D 29/522; F04D 29/541; F04D 29/56; F04D 29/563; F04D 29/64; F04D 29/644; F04D 29/646; F04B 33/00; F04B 33/02; H02K 7/1853; H02K 7/1861; H02K 7/20; H02K 7/18; H02K 57/00; H02K 57/003; H02K 57/006; H02K 2207/00; H02K 2213/06
USPC ..... 310/75 B; 417/234; 290/1 R, 4 R
See application file for complete search history.

(56) References Cited

U.S. PATENT DOCUMENTS 2,803,527 A * 8/1957 Lundahl ..... F04D 25/084 200/60
3,378,193 A * 4/1968 Harris ..... F04D 29/646 415/126
3,510,745 A * 5/1970 Futterer ..... H02J 7/14 307/66
4,701,835 A * 10/1987 Campagnuolo ..... F21L 13/06 320/162
5,411,371 A * 5/1995 Chen ..... F04D 25/105 416/100
5,468,124 A 11/1995 Chen
5,518,370 A 5/1996 Wang et al.
5,998,975 A * 12/1999 Tada ..... H02K 7/1861 322/25
6,050,551 A * 4/2000 Anderson ..... A61L 9/122 239/56

(Continued)

*Primary Examiner* — William H Rodriguez
*Assistant Examiner* — Joseph Herrmann
(74) *Attorney, Agent, or Firm* — Robert C. Montgomery; Montgomery Patent & Design LP.

(57) ABSTRACT

A powered fan is provided having a fan housing, a plurality of fan blades, a motor, and an electrical generation system. The fan blades are mechanically coupled to the motor, both being contained within the fan housing. Rotatably affixed to an exterior portion of the fan housing, and mechanically coupled to the electrical generator, is a hand crank. Electrically coupled to the motor and affixed to some portion of the fan housing is a rechargeable battery. Manipulation of the hand crank generates electricity for powering the motor and/or charging the rechargeable battery. A control pad located on the fan housing allows a user to selectively control the functioning of the fan.

14 Claims, 6 Drawing Sheets

(56) References Cited

U.S. PATENT DOCUMENTS

| | | | | |
|---|---|---|---|---|
| 6,241,478 | B1 * | 6/2001 | Cichetti | F04D 25/08 340/908.1 |
| 6,291,900 | B1 * | 9/2001 | Tiemann | H02P 9/04 290/1 A |
| 6,953,329 | B2 * | 10/2005 | Rardin | F04D 25/08 417/411 |
| 7,239,237 | B2 * | 7/2007 | Hess | H04B 1/086 340/539.1 |
| 7,723,880 | B2 | 5/2010 | Dai | |
| 7,828,524 | B2 * | 11/2010 | Chen | F04D 25/084 415/206 |
| 7,997,565 | B1 * | 8/2011 | Chan | F24F 6/043 261/107 |
| 8,253,272 | B2 * | 8/2012 | Schulzman | F04D 25/068 307/155 |
| 8,641,391 | B2 * | 2/2014 | Pan | F04D 25/08 417/305 |
| 2006/0164037 | A1 | 7/2006 | Kuo | |
| 2009/0123301 | A1 | 5/2009 | Lau | |

* cited by examiner

HAND CRANK-POWERED FAN

RELATED APPLICATIONS

The present invention was first described in and claims the benefit of U.S. Provisional Application No. 61/905,532, filed Nov. 18, 2013, the entire disclosures of which are incorporated herein by reference.

FIELD OF THE INVENTION

The present invention relates generally to a powered fan having a hand crank actuating mechanism.

BACKGROUND OF THE INVENTION

Just about everyone has had to suffer through a power failure. Whether the outage was caused by a man-made event such as equipment failure, or as the result of a natural disaster such as a storm, the results are the same. While flashlights and other battery operated tools help to keep households running, and provide for emergency needs, one need which has gone unfulfilled is that of cooling. Many people, especially the elderly, cannot function, or even survive in periods of high heat. Standard cooling devices such as fans and air conditioners are non-operational during power failures, and there has been no acceptable battery operated substitute to date. These same cooling problems occur when camping, at outdoor events, or virtually any location where power is not available. Accordingly, there exists a need for a means by which one can be kept cool, without reliance on conventional electrically powered cooling devices.

SUMMARY OF THE INVENTION

The disadvantages of the prior art are overcome by the present invention in providing a manually operated fan having a base assembly, a fan housing, a fan assembly having a plurality of fan blades, an generator assembly having a crank handle, and a motor operatively connected to the fan assembly and in electrical communication with the generator assembly. The generator assembly provides an electromotive force to the motor to drive the fan assembly when a user rotates the crank handle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
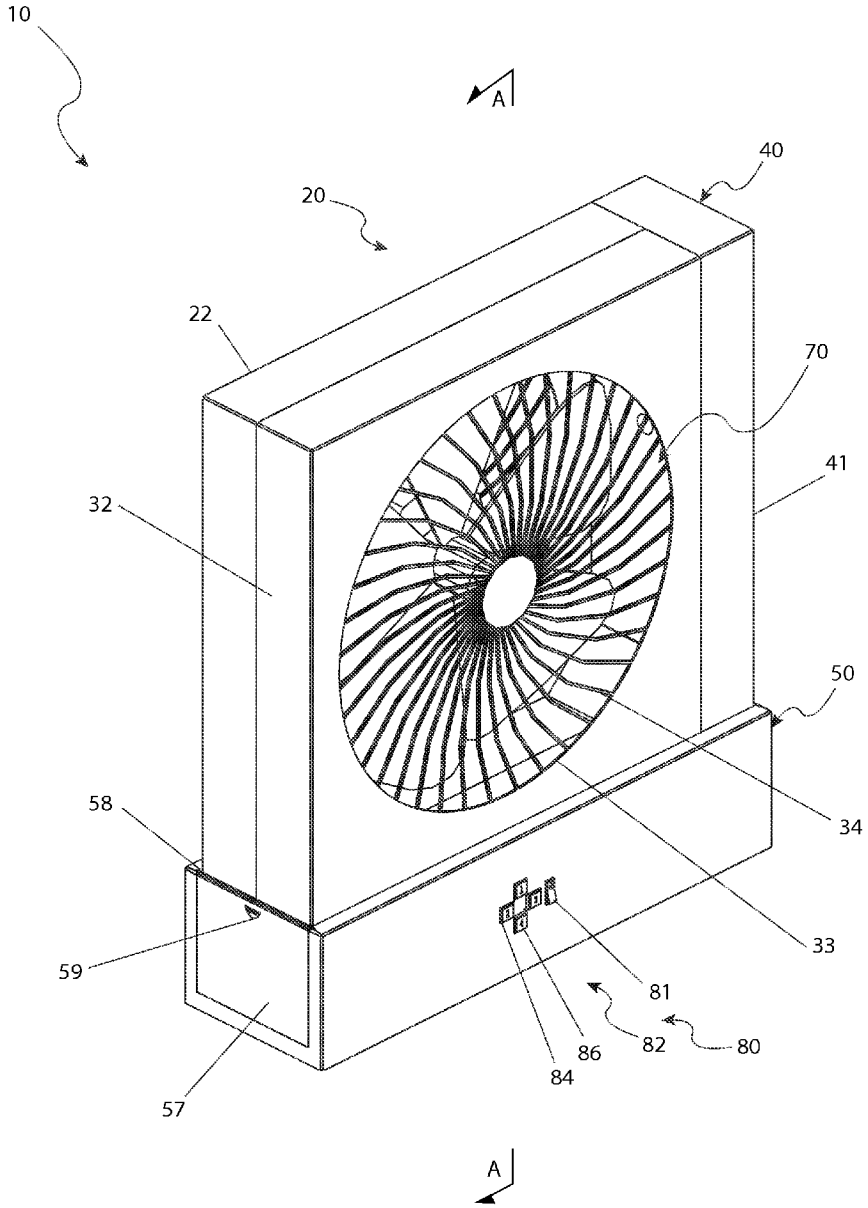
FIG. 1 is an isometric view of a manual-operated fan 10 in accordance with the preferred embodiment of the present invention.

10 manual-operated fan
20 fan housing
22 housing inlet side
23 inlet opening
24 inlet side cage
25 motor support
26 housing fastener
27 fastener aperture
32 housing outlet side
33 outlet opening
34 outlet side cage
38 indicia
40 generator assembly
41 generator housing
42 crank
43 crank hub
44 shaft aperture
45 crank handle
46 generator shaft
47 generator shaft flat
48 generator shaft thread
49 crank retainer
50 base assembly
51 first battery compartment
52 first battery compartment cover
53 first cover slide way
54 first cover pull
56 second battery compartment
57 second battery compartment cover
58 second cover slide way
59 second cover pull
61 motor
62 motor shaft
63 snap ring
64 snap ring groove
65 motor shaft flat
66 external thread
70 fan assembly
71 fan blade
72 fan hub
73 fan hub center bore
74 fan hub retainer
75 internal thread
80 control pad
81 ON/OFF switch
82 multi-key switch pad
83 first switch
84 second switch
85 third switch
86 fourth switch
87 power source assembly
88 capacitor
89 battery charging circuit
90 generator
95 rechargeable battery
97 replaceable battery

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a manual-operated fan (herein referred to as the "apparatus") 10, which provides a means to generate the electrical power necessary to drive a personal ventilation and air recirculation device by inputting the necessary rotary motion through a provided hand-operated crank 42, and a method to control the operation thereof. The apparatus 10 is configured with a multi-key switch pad 42 which also allows said apparatus 10 to be operated by dry-cell storage batteries 88.

Figure 2:
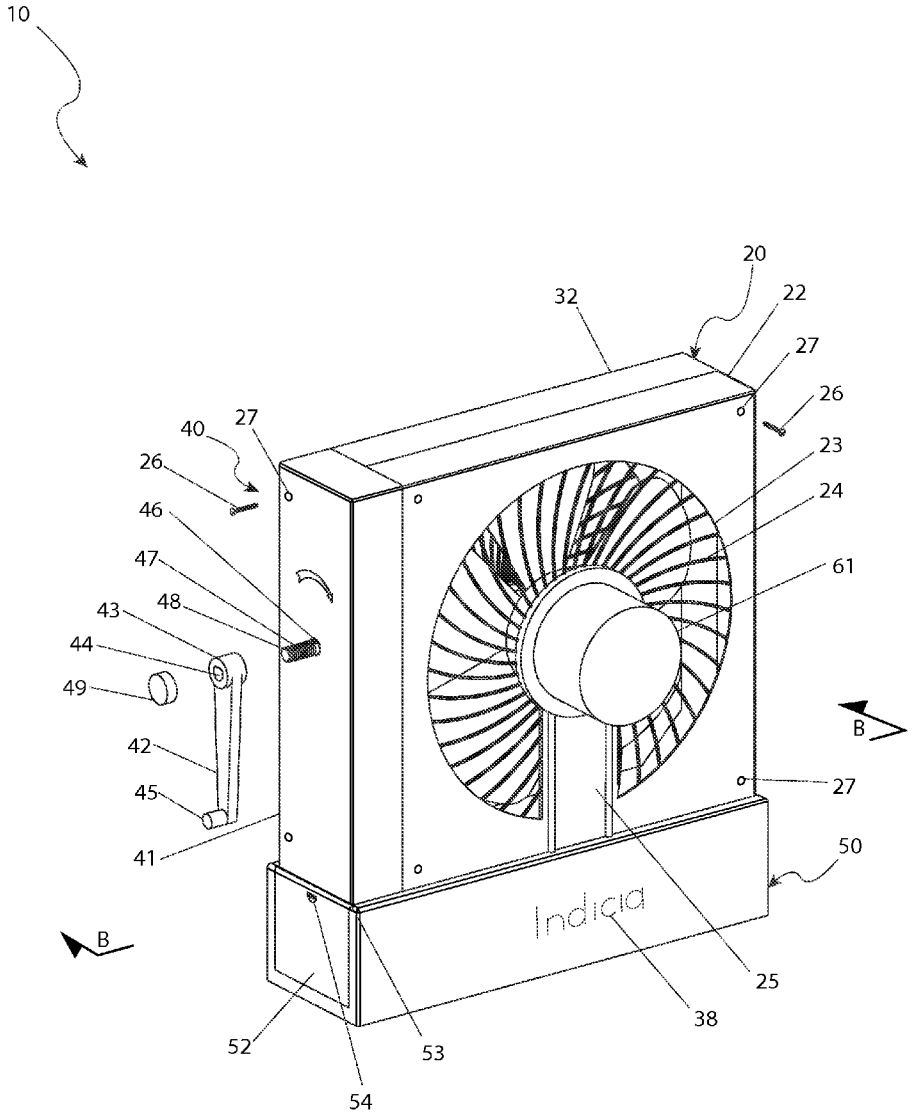
FIG. 2 is a partially exploded isometric view of the manual-operated fan 10 in accordance with the preferred embodiment of the present invention.

Referring now to FIG. 1, an isometric view, and FIG. 2, a partially exploded isometric view from another angle, of the apparatus 10 according to the preferred embodiment of the present invention, are disclosed. The apparatus 10 includes a fan housing 20, a generator assembly 40, a base assembly 50, a motor 61, a fan assembly 70, and a power souse assembly 87. The fan housing 20 includes a housing inlet side 22, and a housing outlet side 32. The fan housing 20 is comprised preferably of a thermoplastic material and constructed from a plurality of injection-molded parts to form a rectangular polyhedron configured to form such overlapping and interconnected portions as to adequately house, and provide support for the motor 61, and the fan assembly 70. The fan housing 20 may be presented in a wide variety of decorative colors and surface finish textures. However, it is understood that other materials, or other housing shapes, may be utilized without limiting the scope of the apparatus 10. Additionally, it is envisioned that some surface portions of the fan housing 20 may comprise various indicia 38 which may provide script or symbols based upon directions for use, or other script or logos based upon a user's preference and may include images such as, but not limited to, personal names, symbols, lines, pictures, and the like, in various colors and patterns, to further customize and personalize the apparatus 10.

The housing inlet side 22 of the fan housing 20 is provided with a circular inlet opening 23 for the entrance of a flow of air into the apparatus 10. Disposed in the inlet opening 23 is the inlet side cage 24. The inlet side cage 24 is comprised of an outward spiraling array of ribs. In the preferred embodiment, the inlet side cage 24 is constructed of a thermoplastic material configured to protect the fan assembly 70. Disposed at the center of the inlet side cage 24, and extending downward to the periphery of the inlet opening 23 is a motor support 25, which is an annular ring, molded to a plate and configured to bear the weight of the attached motor 61. It may be necessary to incorporate other provisions into the motor support 25 to provide additional mounting structure for the motor 61, however, it is understood that any such eventualities do not modify the scope or intent of the present apparatus.

The housing outlet side 32 is attached to the housing inlet side 22 by a plurality of housing fasteners 26 which are inserted through fastener apertures 27 in the housing inlet side 22. The housing outlet side 32 is provided with a circular outlet opening 33 for the egress of air from the apparatus 10. Disposed in the outlet opening 33 is the outlet side cage 34. The outlet side cage 34 is comprised of an outward spiraling array of ribs further comprised preferably of a thermoplastic material configured to protect and prevent access to the fan blades 71. In one (1) embodiment of the present invention, the ribs of the outlet side cage 34 are formed to cause the output air flow to be directed in a particular direction. In this case, the outlet side cage 34 is mounted in the fan housing 20 such that is can be rotated to selectively direct the direction of the output air flow as desired.

The generator assembly 40 includes the generator housing 41 that provides structural support and covering protection for the generator 90 (FIG. 6) and the requisite generator crank mechanism components. The generator 90, as will be discussed in greater detail below, includes a generator shaft 46 that extends outwardly from the generator housing 40. Formed onto the generator shaft 46 is a generator shaft flat 47 and a generator shaft thread 48. The crank 42 is attached to the generator shaft 46 at a crank hub 43 for a user to input the necessary rotary motion to cause an electrical current to be produced by the generator 90. The crank 42 is preferably comprised of a rigid polymer material. However, other materials, such as some metals, may also be utilized without narrowing the scope of the apparatus 10. The crank hub 43 is provided with a shaft aperture 44 having an appropriate diameter to be accommodated on the generator shaft 46 and a feature complimentary to the generator shaft flat 47 so that the input torque is positively transmitted to the generator 90. The crank 42 is secured to the generator shaft 46 by engaging a complimentary thread cut, or formed, into the crank retainer 49 with the generator shaft thread 48. Disposed on the opposite end of the crank 42 from the crank hub 43 is a crank handle 45. The crank handle 45 is the point of the crank 42 which the user would grasp to apply the requisite rotary motion input.

Figure 3:
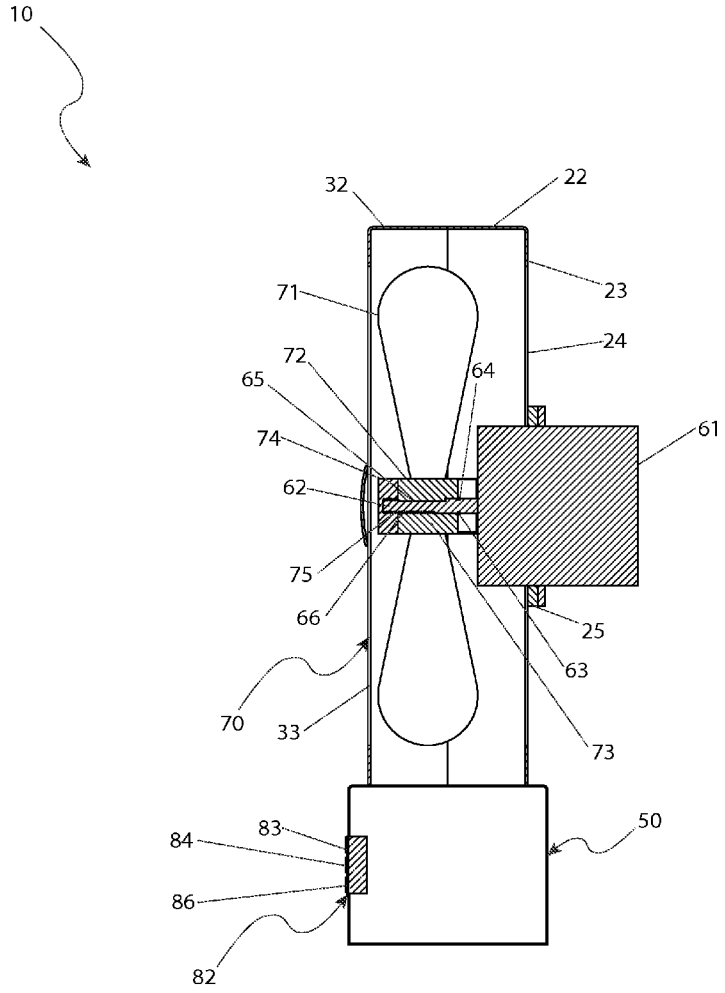
FIG. 3 is a section view along a line A-A as shown on FIG. 1 of the manual-operated fan 10 in accordance with the preferred embodiment of the present invention.

Referring now to FIG. 3, a section view along line A-A as shown in FIG. 1 of the apparatus 10, according to the preferred embodiment of the present invention, is disclosed. The motor 61 is attached to the motor support 25 which is molded into the inlet side cage 24. The motor 61 is comprised of any of a variety of commercially available, copper wound, low voltage, small frame, direct current, motors 61 with a cylindrical motor shaft 62 capable of generating sufficient torque to provide the desired rotation of the fan assembly 70. The motor 61 is electrically powered by the power source assembly 87, through a two-position ON/OFF switch 81 according to the selection of one (1) of a plurality of push button switches 83-86 on the multi-key switch pad 82. The motor shaft 62 is preferably equipped with an annular snap ring groove 64, a motor shaft flat 65, and an external thread 66 at the distal end.

The fan assembly 70 is comprised of a plurality of the fan blades 71 each individually disposed at their root to the fan hub 72. The fan hub 72 is provided with a center bore 73 that is configured to be complimentary to the motor shaft 62 and the motor shaft flat 65. A snap ring 63 is retained in the snap ring groove 64 on the motor shaft 62 to provide a positive stop for the insertion of the motor shaft 62 into the center bore 73 of the fan hub 72. The fan assembly 70 is retained on the motor shaft 62 by means of a fan hub retainer 74 engaged with the external thread 66 of the motor shaft 62. The fan hub retainer 74 is provided with an internal thread 75 which is complimentary to the external thread 66. The external thread 66 and the corresponding internal thread 75 are best formed in the direction which is opposite from the normal rotation of the motor 61 to prevent torsional loosening of the hub retainer 74 during operation. The plurality of fan blades 71 are each formed in like angular twist and oriented along the fan hub 72 at an angle perpendicular to the rotational axis of the fan hub 72. The curvature and angular disposition of the fan blades 71 is optimized to reduce vortices and keep the air flow generated by them laminar.

Figure 4:
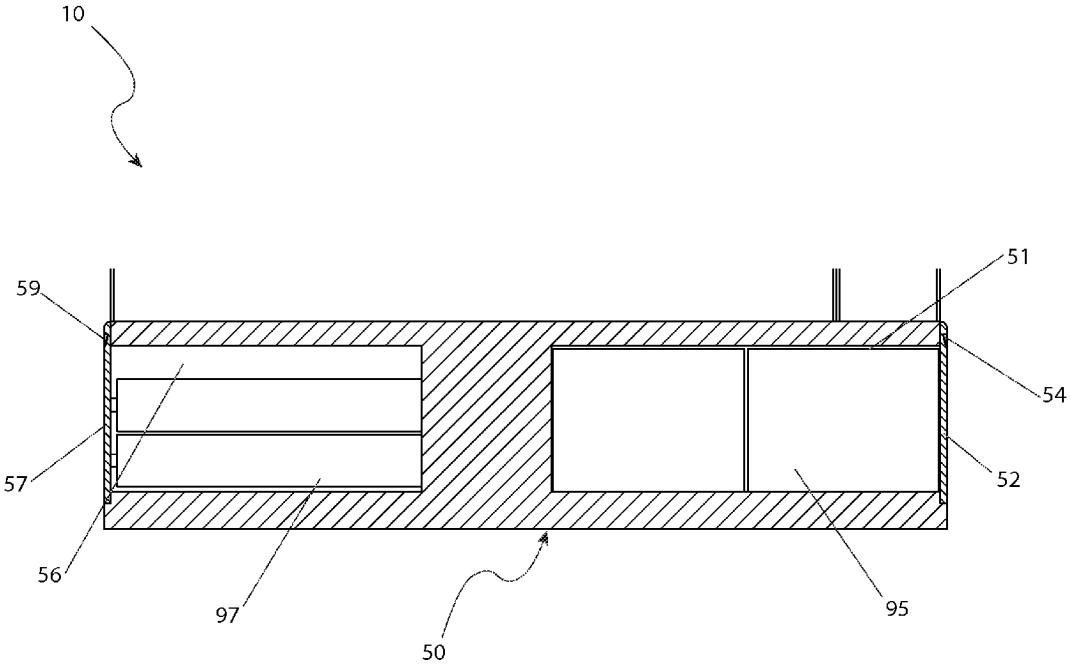
FIG. 4 is a section view along line B-B as shown on FIG. 2 of the base assembly 50 of the manual-operated fan 10 in accordance with the preferred embodiment of the present invention.

Referring now to FIG. 4, a section view along line B-B as shown in FIG. 2 of the apparatus 10, according to the preferred embodiment of the present invention, is disclosed. Disposed within the base assembly 50 is the power source assembly 87 that powers the motor 61 through the various means described herein. In this manner, the power source assembly 87 can utilize the power provided by at least one rechargeable battery 95, at least one non-rechargeable replaceable battery 97, or the generator assembly 40. The base assembly 50 includes a first battery compartment 51, and at the opposite side, a second battery compartment 56. The first battery compartment 51 is configured to house a rechargeable battery 95, which in some modes of operation would provide the necessary electrical energy to drive the motor 61. The first battery compartment 51 is closed by a first battery compartment cover 52. The two (2) opposite vertical edges of the first battery compartment cover 52 are tapered from the inner side to the outer side to fit into, and be retained in, first cover slide ways 53 in the base assembly 50 which are similarly configured. Disposed in the outer surface of the first battery compartment cover 52 is a first cover pull 54. The first cover pull 54 is preferably a tapered semi-circular indentation which can be accessed by the user's fingernail, or some tool, to extricate the first battery compartment cover 52 from the first cover slide ways 53 in order to install or replace a rechargeable battery 95.

The second battery compartment 56 is configured to house a set of replaceable batteries 97, which in one (1) mode of operation provides the electrical energy to drive the motor 61. The second battery compartment 56 is closed by a second battery compartment cover 57. The two (2) opposite vertical edges of the second battery compartment cover 57 are tapered from the inner side to the outer side to fit into, and be retained in, second cover slide ways 58 in the base assembly 50 which are similarly configured. Disposed in the outer surface of the second battery compartment cover 57 is a second cover pull 59. The second cover pull 59 is configured to extricate the second battery compartment cover 57 from the second cover slide ways 58 in order to install or replace a replaceable battery 97. It is understood that the apparatus 10 may be configured without a second battery compartment 56, if desired, thereby limiting the function to the level achieved by the rechargeable batteries 95.

Figure 5:
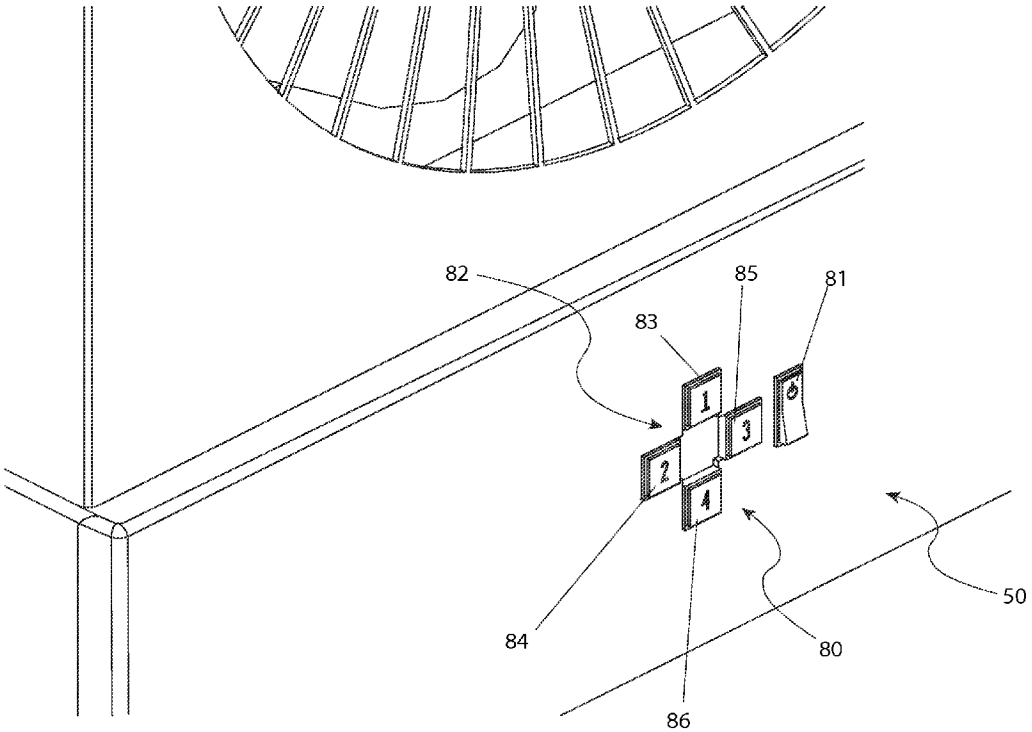
FIG. 5 is a view of the layout of a control pad 80 of the manual-operated fan 10 in accordance with the preferred embodiment of the present invention; and, FIG. 6 is a block diagram of the electrical components of the manual-operated fan 10 in accordance with the preferred embodiment of the present invention.
Figure 6:
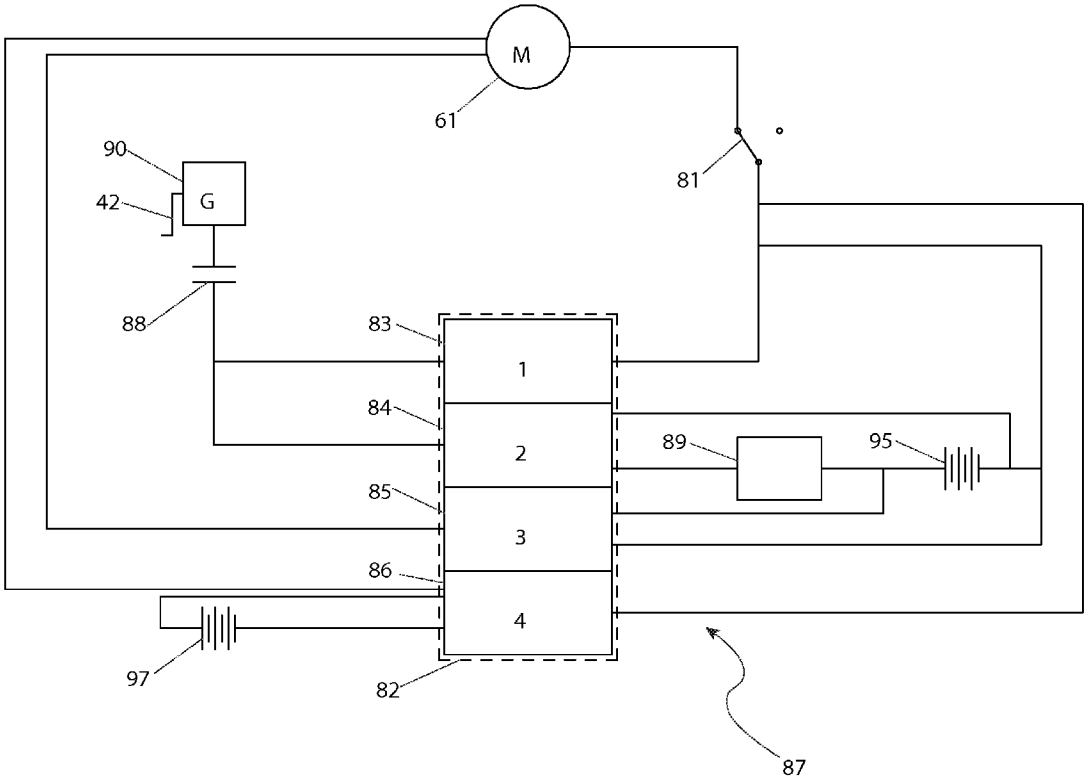

Referring now to FIG. 5 a view of the control pad 80, and FIG. 6, a block diagram of the electrical components of the apparatus 10, according to the preferred embodiment of the present invention, are disclosed. The control pad 80 is comprised of the electrical switches which control the multiple functions of the apparatus 10. The control pad 80 includes an ON/OFF switch 81 and a multi-key switch pad 82 with interlocking control switches 83-86 such that no two (2) functions are activated simultaneously. The ON/OFF switch 81 for the motor 61 is comprised of a two-position (2) selector switch, such as a rocker-type switch.

As can be seen in FIG. 6, in one (1) mode of operation, the ON/OFF switch 81 is set to the ON position and the first switch 83 of the multi-key switch pad 82 is depressed thereby completing a circuit between the generator 90, the capacitor 88, and the motor 61. In this configuration, when the crank 42 is turned in the proper direction the electrical energy from the generator 90 is directed to the capacitor 88. When the capacitor 88 reaches full charge the electrical energy flows through the, now closed, ON/OFF switch 81 to the motor 61 thereby turning the fan blades 71 to supply a flow of air to the user.

In an alternate mode of operation, the second switch 84 of the multi-key switch pad 82 is depressed thereby removing the ON/OFF switch 81 and the motor 61 from the electrical circuit. An electrical circuit is established between the generator 90, the capacitor 88, the battery charging circuit 89, and the rechargeable battery 95. In this configuration, when the crank 42 is turned in the proper direction the electrical energy from the generator 90 is directed to the capacitor 88. When the capacitor 88 reaches full charge the electrical energy flows to the battery charging circuit 89 which regulates and limits the flow of electricity to the rechargeable battery 95. In this mode of operation the rechargeable batteries 95 are recharged while the motor 61 operates.

In a second alternate mode of operation, the third switch 85 of the multi-key switch pad 82 is depressed thereby removing the generator 90 and the capacitor 88 from the electrical circuit. An electrical circuit is established between the rechargeable batteries 95, the ON/OFF switch 81, and the motor 61. When the ON/OFF switch 81 is closed the electrical energy flows from the rechargeable batteries 95 to the motor 61 thereby turning the fan blades 71 to supply a flow of air to the user.

In a third alternate mode of operation, the fourth switch 86 of the multi-key switch pad 82 is depressed thereby establishing an electrical circuit between the replaceable batteries 97, the ON/OFF switch 81, and the motor 61. When the ON/OFF switch 81 is closed the electrical energy flows from the replaceable batteries 97 to the motor 61 thereby turning the fan blades 71 to supply a flow of air to the user. It is understood that the apparatus 10 may be configured without the capacitor 88 and the multi-key switch pad 82, if desired, thereby providing a mode of operation in which the generator 90 provides a flow of electrical energy to the rechargeable batteries 95 through the battery charge circuit 89, and said rechargeable batteries 95 supply a flow of electrical energy through the ON/OFF switch 81 to the motor 61.

In a fourth alternate mode of operation, the fourth switch 86 of the multi-key switch pad 82 is depressed thereby directly connecting the generator 90 to the motor 61 without directing electrical power to either the capacitor 88 or the rechargeable batteries 97. The fourth switch 86 is thereby a direct connect switch for the generator 90 and motor 61 connection.

The preferred embodiment of the present invention can be utilized in a simple and straightforward manner with little or no training. After initial purchase or acquisition of the apparatus 10, it would be installed on a firm, stable, horizontal surface as indicated in FIG. 1. The method of installing and utilizing the apparatus 10 may be achieved by performing by performing a series of steps. It can be appreciated that certain operational steps herein described can be performed in alternative order and as such should not be viewed as a limiting factor. After acquiring a model of the apparatus 10 having a desired style to meet the user's taste, a mode of operation as previously described would be selected and the correct switch 83-86 on the multi-key switch pad 82 would be depressed. If the desired operational configuration resulted in the operation of the motor 61; the ON/OFF switch 81 would be switched to the "ON" position thereby supplying the user with a flow of air.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A manually operated fan, comprising:

a base assembly;

a fan housing disposed upon said base assembly;

a fan assembly disposed within said fan housing;

a generator assembly comprising a generator having a crank handle for accepting rotational input from a user to generate a first electrical power in response to rotation of said crank handle operatively connected to said generator and a capacitor to store said first electrical power;

at least one rechargeable battery to provide a second electrical power; and at least one non-rechargeable battery to provide a third electrical power;

a motor operatively connected to said fan assembly and in selectable electrical communication with said generator assembly, said at least one rechargeable battery, and said at least one non-rechargeable battery to receive a selected one of said first electrical power from said generator assembly, said second electrical power from said at least one rechargeable battery, and said third electrical power from said at least one non-rechargeable battery;

a two-position ON/OFF switch operable to open and close an electric circuit between said motor and the selected one of said generator assembly, said at least one rechargeable battery, and said at least one non-rechargeable battery;

a first mode selection switch operable to selectively direct said first electrical power from said generator assembly to said motor;

a second mode selection switch operable to selectively direct said first electrical power from said generator assembly to said at least one rechargeable battery;

a third mode selection switch operable to selectively direct said second electrical power from said at least one rechargeable battery to said motor; and, a fourth mode selection switch operable to selectively direct said third electrical power from said at least one non-rechargeable battery to said motor.

2. The fan of claim 1, wherein said fan assembly further comprises:

a fan hub; and, a plurality of fan blades;

wherein each of said plurality of fan blades are affixed to said fan hub so as to cause a flow of air when said fan assembly is rotated by said motor.

3. The fan of claim 2, wherein said fan housing further comprises:

a housing inlet side; and, a housing outlet side;

wherein said fan assembly is operatively disposed between said housing inlet side and said housing outlet side; and, wherein said fan assembly rotation causes said flow of air to pass into said housing inlet side and out of said housing outlet side.

4. The fan of claim 3, wherein said fan housing further comprises:

an inlet opening formed in said inlet side and having an inlet side cage disposed therein; and, an outlet opening formed in said outlet side and having an outlet side cage disposed therein.

5. The fan of claim 4, wherein said outlet side cage is rotatably mounted in said housing outlet side and is operable to be rotated by said user to direct said air flow in a desired direction.

6. The fan of claim 1, wherein said generator assembly further comprises a generator housing affixed to said fan housing wherein said generator assembly is positioned within said generator housing, and, wherein said crank handle is removably attached to said generator.

7. The fan of claim 1, wherein said at least one rechargeable battery and said at least one non-rechargeable battery are positioned within said base assembly, and wherein said two-position ON/OFF switch, said first mode selection switch, said second mode selection switch, said third mode selection switch and said fourth mode selection switch are positioned on an exterior of said base assembly.

8. A fan comprising:

a base assembly;

a fan housing disposed upon said base assembly;

a fan assembly disposed within said fan housing;

a generator assembly comprising a generator to provide a first electrical power and a capacitor to store said first electrical power;

a crank handle operatively connected to said generator to generate said first electrical power in response to a rotational input;

at least one rechargeable battery to provide a second electrical power; and at least one non-rechargeable battery to provide a third electrical power;

a motor operatively connected to said fan assembly and in selectable electrical communication with said generator assembly, said at least one rechargeable battery, and said at least one non-rechargeable battery to receive a selected one of said first electrical power from said generator assembly, said second electrical power from said at least one rechargeable battery, and said third electrical power from said at least one non-rechargeable battery;

a two-position ON/OFF switch operable to open and close an electric circuit between said motor and the selected one of said generator assembly, said at least one rechargeable battery, and said at least one non-rechargeable battery;

a first mode selection switch operable to selectively direct said first electrical power from said generator assembly to said motor to drive said motor;

a second mode selection switch operable to selectively direct said first electrical power from said generator assembly to said at least one rechargeable battery to charge said at least one rechargeable battery;

a third mode selection switch operable to selectively direct said second electrical power from said at least one rechargeable battery to said motor to drive said motor; and, a fourth mode selection switch operable to selectively direct said third electrical power from said at least one non-rechargeable battery to said motor to drive said motor.

9. The fan of claim 8, wherein said fan assembly further comprises:

a fan hub; and, a plurality of fan blades;

wherein each of said plurality of fan blades are affixed to said fan hub so as to cause a flow of air when said fan assembly is rotated by said motor.

10. The fan of claim 9, wherein said fan housing further comprises:

a housing inlet side; and, a housing outlet side;

wherein said fan assembly is operatively disposed between said housing inlet side and said housing outlet side; and, wherein said fan assembly rotation causes said flow of air to pass into said housing inlet side and out of said housing outlet side.

11. The fan of claim 10, further comprising an outlet side cage rotatably mounted in said housing outlet side and operable to be rotated to direct said flow of air exiting said housing outlet side in a desired direction.

12. The fan of claim 11, wherein said generator assembly further comprises a generator housing affixed to said fan housing wherein said generator assembly is positioned within said generator housing.

13. The fan of claim 12, wherein said base assembly further comprises:

a first battery compartment; and, a second battery compartment;

wherein said first battery compartment is configured to house said at least one rechargeable battery; and, wherein said second battery compartment is configured to house said at least one non-rechargeable battery.

14. A fan comprising:

a base assembly;

a fan housing connected to said base assembly;

fan assembly positioned in said fan housing and comprising a plurality of fan blades;

a generator housing connected to said fan housing;

a generator assembly positioned within said generator housing and comprising a generator to provide a first electrical power and a capacitor to store said first electrical power;

a crank handle operatively connected to said generator to generate said first electrical power in response to a rotational input;

at least one rechargeable battery to provide a second electrical power; and, at least one non-rechargeable battery to provide a third electrical power;

a motor operatively connected to said fan assembly and in selectable electrical communication with said generator assembly, said at least one rechargeable battery, and said at least one non-rechargeable battery to receive a selected one of said first electrical power from said generator assembly, said second electrical power from said at least one rechargeable battery, and said third electrical power from said at least one non-rechargeable battery;

a two-position ON/OFF switch operable to open and close an electric circuit between said motor and a selected one of said generator assembly, said at least one rechargeable battery, and said at least one non-rechargeable battery;

a first mode selection switch operable to selectively direct said first electrical power from said generator assembly to said motor to drive said motor;

a second mode selection switch operable to selectively direct said first electrical power from said generator assembly to said at least one rechargeable battery to charge said at least one rechargeable battery and direct said second electrical power from said at least one rechargeable battery to said motor to drive said motor;

a third mode selection switch operable to selectively direct said second electrical power from said at least one rechargeable battery to said motor to drive said motor; and a fourth mode selection switch operable to selectively direct said third electrical power from said at least one non-rechargeable battery to said motor to drive said motor.

* * * * *